United States Patent [19]

Komatsu et al.

[11] 4,200,773

[45] Apr. 29, 1980

[54] SWITCH

[75] Inventors: Hiroaki Komatsu; Tsumoru Oka, both of Tohda, Japan

[73] Assignee: Alps Electric Co., Ltd., Tokyo, Japan

[21] Appl. No.: 924,961

[22] Filed: Jul. 17, 1978

[30] Foreign Application Priority Data

Jul. 19, 1977 [JP] Japan ..... 52-96320[U]

[51] Int. Cl.[2] ..... H01H 19/48; H01H 21/68

[52] U.S. Cl. ..... 200/11 R; 200/11 G; 200/11 DA; 200/11 K; 200/291; 200/303

[58] Field of Search ..... 200/11 R, 11 A, 11 C, 200/11 EA, 11 DA, 11 G, 11 K, 11 TW, 17 R, 14, 155 R, 291, 292, 303, 307

[56] References Cited

U.S. PATENT DOCUMENTS

| | | | |
|---|---|---|---|
| 3,255,319 | 6/1966 | Paine | 200/11 |
| 3,284,584 | 11/1966 | Didyk | 200/291 X |
| 3,511,956 | 5/1970 | Fields | 200/336 |
| 3,518,389 | 6/1970 | Doering, Jr. et al. | 200/11 G X |
| 3,579,257 | 5/1971 | Spreitzer | 200/292 X |
| 3,594,527 | 7/1971 | Brant et al. | 200/293 X |
| 3,983,352 | 9/1976 | Ellis, Jr. et al. | 200/11 C X |
| 4,006,442 | 2/1977 | Mega | 338/150 |
| 4,038,504 | 7/1977 | McAnulty et al. | 200/11 DA |
| 4,145,585 | 3/1979 | Iwasaki | 200/11 DA |
| 4,146,758 | 3/1979 | Hiwatahi et al. | 200/11 DA |

*Primary Examiner*—J. R. Scott

*Attorney, Agent, or Firm*—Guy W. Shoup; Gerard F. Dunne

[57] ABSTRACT

A switch of an extremely small thickness is made of a reduced number of parts and can be easily assembled. The switch comprises a pair of complementary case members each of which has a plurality of fixed contacts having integrally formed terminals and a common fixed contact having an integrally formed terminal; and an operation member having a lever portion, and a disc portion disposed between the case members. The operation member is provided on its outer faces with identically shaped movable contact members having contacts on the outer surfaces thereof. The upper ends of the case members define a slot form which the lever portion of the operation member is upwardly projected, and the movement of the lever portion is restricted by the slot. The operation member is securely supported in the case members by horizontal fastener members extended from both faces of the former to the outer surfaces of the latter.

13 Claims, 4 Drawing Figures

SWITCH

BACKGROUND OF THE INVENTION

The present invention relates to a switch and, more particularly, to a switch of a small thickness which can be made of a reduced number of parts and which can be easily assembled.

SUMMARY OF THE INVENTION

An object of the present invention is to provide a switch having a small thickness and which has a simple construction made of a reduced number of parts.

To this end, according to the present invention, a switch is provided which includes first and second case members adapted to be joined together, each of which has a generally circular recess in the inner surface thereof and a plurality of fixed contacts integrally formed with the respective case member to fit within the recess thereof. A respective common fixed contact is also integrally formed with each case member to fit within the recess thereof. An operation member is rotatably disposed between the first and second case members and has a lever portion projecting therefrom and a disc portion positioned within a spaced defined by the recesses in the first and second case members. Fastener portions extending from respective faces of the disc portion of the operation member are passed through openings in the first and second case members so as to engage the outer surfaces thereof to join the first and second case members firmly together. A first movable contact member is secured to one face of the disc portion and is slidable on the contacts disposed within the recess in the first case member, and a second movable contact member is secured to the other face of the disc portion and is slidable on the contacts disposed within the recess in the second case member.

The above and other objects as well as advantageous features of the invention will become apparent from the following description of the preferred embodiment taken in conjunction with the accompanying drawings.

DESCRIPTION OF THE PREFERRED EMBODIMENT

An embodiment of the present invention will be described with reference to the accompanying drawings.

Figure 1:
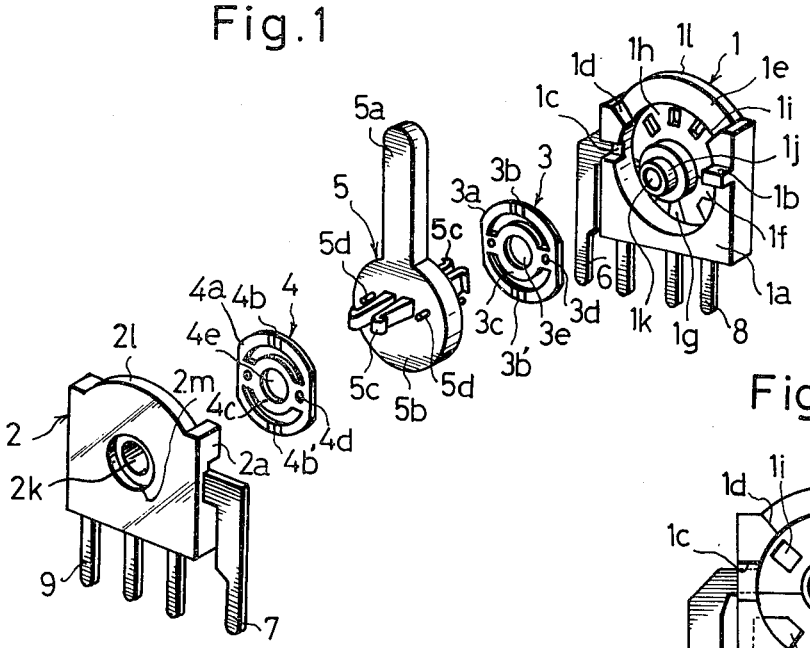
FIG. 1 is an exploded view of an embodiment of the present invention.

FIG. 1 is an exploded view of an embodiment of the present invention, which shows each of the parts thereof in perspective.

Figure 2:
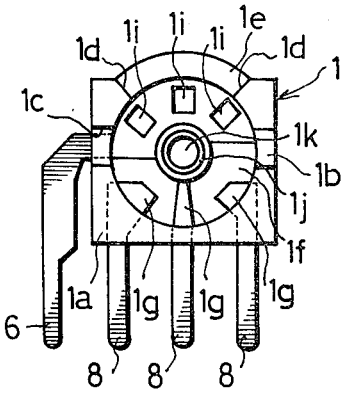
FIG. 2 is a plan view of one of the case members of the embodiment as shown in FIG. 1.

Referring to the drawings, reference numerals 1 and 2 each denote respective ones of a pair of case members made of an insulating material, such as a synthetic resin. The case members are generally similar and only one, case member 1, will be described in detail. The case member 1 includes a generally circular base portion 1*f* which is surrounded by the upstanding peripheral portion 1*a* of the case member. The peripheral portion 1*a* rises to a height above that of the base portion 1*f*. The upstanding peripheral portions 1*a* is provided with projections 1*b* and a recess. The projection and recess of the same case member are spaced from one another and lie oppositely from the recess and projection of the other one member. The projections and recesses are engageable by being interfitted in an complementary manner. In the base portion 1*f*, a cylindrical portion 1*j* is provided for supporting a shaft. The cylindrical portion projects inwardly from the base portion and has an opening 1*k* extending through the central portion thereof. That section of the base portion 1*f* around the shaft supporting portion 1*j* is provided, as shown in FIG. 2, with a plurality of fixed contacts 1*g* and a common contact 1*h*, which are radially disposed with respect to the shaft supporting portion 1*j*. The common contact 1*h* approaches being semi-circular and is provided with openings or recesses 1*i* arranged radially, the number of which corresponds to that of the fixed contacts 1*g*. The openings 1*i* provide for a clicking or detent operation of the switch, as well be described below.

The fixed contacts 1*g* each have a terminal portion 8 integrally formed therewith, and the common contact 1*h* has a terminal portion 6 integrally formed therewith. The contacts 1*g* and 1*h* are fitted in the case member 1 by insert-molding with the free end portions of the terminal portions extending out of the case member 1.

Figure 3:
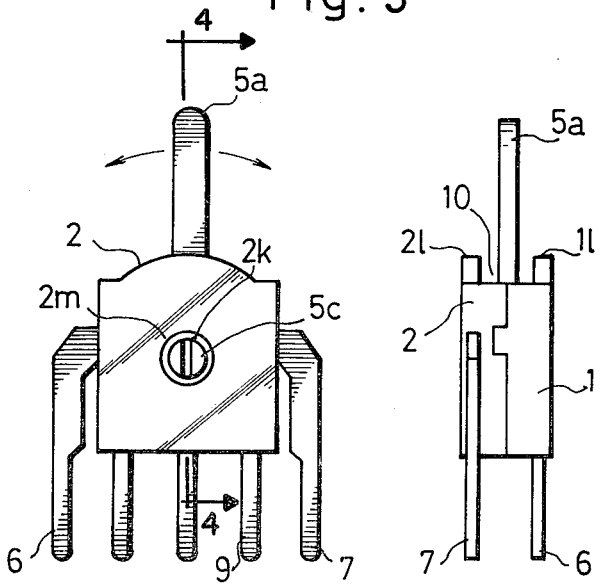
FIG. 3 is rear and side elevational views, respectively, of the embodiment as shown in FIG. 1.
Figure 4:
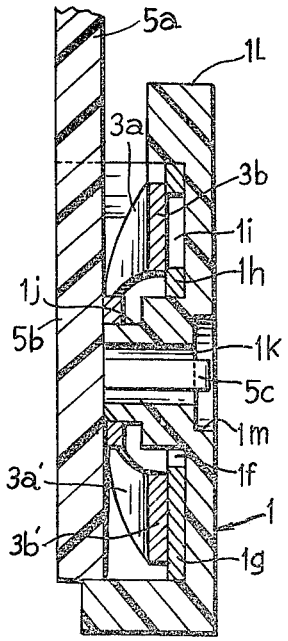
FIG. 4 is an enlarged sectional view taken along line 4—4 of FIG. 3.

Reference numeral 1*d* denotes respective inclined portions formed at the upper ends of the upstanding peripheral portion 1*a*. These inclined portions 1*d* form a slot 10 therebetween as shown in FIG. 3 when the case members 1 and 2 are joined together in a manner as will be described later. The slot 10 is defined by the inclined portions 1*d* and arc-shaped portions 1*l* and 2*l* of the case members 1 and 2. From this slot 10, a lever portion 5*a* of an insulating operation member 5 is projected for rotation. The case member 2 is constructed in the same manner as the case member 1 described in detail above.

Reference numerals 3 and 4 denote movable contact members each made from a resilient metal sheet. The contact member 3 is provided with a circular outer arm portion 3*a* and a circular inner arm portion 3*c*, which are concentrically formed with respect to a central hole 3*e*. From the upper and lower portions of the outer arm portion 3*a*, contacts 3*b* and 3*b'* are projected. Small holes 3*d* are provided in the side portions of the outer arm portion 3*a*. The contact member 4 is constructed in the same manner as the contact member 3 described above. It is necessary that the contact members 3 and 4 be so disposed that the surfaces containing the contacts face outwardly from one another to allow the contacts 3*b*, 3*b'*, and 4*b*, 4*b'* to be engaged with the corresponding fixed contacts or common contacts.

Reference numeral 5 denotes an insulating operation member made, for example, from a synthetic resin and disposed between the movable contact members 3 and 4. Reference numeral 5*a* denotes a lever portion of the operation member 5, and 5*b* a disc portion thereof integrally formed with the lever portion. A respective bifurcated fastener portion 5*c* extends outwardly from the central area of each face of the disc portion 5*b*, and small cylindrical projections 5*d* extend outwardly from the disc portion so as to lie respectively on opposite sides of a fastener portion. The operation member 5 consisting of lever portion 5*a*, disc portion 5*b*, fastener portions 5*c*, and small projections 5*d* is unitarily molded in a manner similar to that of the case members 1 and 2.

The switch according to the present invention consists of the above-mentioned parts, and the assembling of these parts will be described below.

First, the fastener portions 5c of the insulating operation member are press-fitted into the central holes 3e and 4e of the movable contact members 3 and 4 with the small projections 5d fitted into the corresponding small holes 3d and 4d. Then, the ends of the small projections 5d are tightened down to secure the contact members 3 and 4 to respective faces of the operation member 5. The fastener portions 5c of the operation member 5 are thereafter press-fitted through the openings 1k and 2k in the shaft supporting portions of the case members 1 and 2. The outer end portions of the fastener portions 5c are angled to provide cam surfaces which urge the bifurcated end portions of each fastener portion toward one another as they are slid through the opening 1k or 2k. Thereafter, the outer end portions of the fastener 5c snap over the flanges 1m or 2m provided at the outer ends of the openings 1k or 2k, and recessed into the rear wall portion of the respective case member, as shown for the flange 2m. In this way, the outer end portion of the fastener portions need not extend outwardly from the rear wall of the case members. At this time, the shaft supporting portions 1j and 2j (the shaft supporting portion 2j is not shown) of the case members 1 and 2 have been inserted into the central holes 3e and 4e of the movable contact members 3 and 4. Thus, the contact members 3 and 4 are housed in the circular base portions 1f and 2f and resiliently contact the inner surfaces thereof so that the contacts 3b and 4b and contacts 3b' and 4b' can be slid on the common contacts 1h and 2h, and fixed contact 1g and 2g, respectively.

The projections 1b and 2b, and recesses 1c and 2c are engaged with one another to prevent the case members 1 and 2 from being relatively rotated. When the case members are joined together in the above-described manner, a slot 10 as shown in FIG. 3 is formed, which is defined by the arc-shaped portions 1l and 2l and the inclined portions 1d and 2d. From this slot 10, the lever portion 5a of the operation member 5 is outwardly extended, and this lever portion 5a can be rotated between the opposed inclined portions while being guided along the slot 10.

Now, the operation of the switch according to the present invention will be described.

When the lever portion 5a of the operation member 5 is rotated in either of the directions of the arrows as shown in FIG. 3, the contacts 3b' and 4b' on the movable contact members are engaged with and disengaged from, in order, the fixed contacts 1g and 2g; and the other contacts 3b and 4b slide along the common contacts 1h and 2h. Thus, electrical switching can be effected via the respective terminal portions 8, 6. The shifting actions between the fixed contacts will be transmitted in a stepped manner to the operator owing to the openings or recesses 1i and 2i provided in the common contacts and corresponding to the fixed contacts.

According to the switch of the present invention, the construction and operation of which are as described above, the case members 1 and 2, and the insulating operation member 5, can be integrally formed as a unit by using a mold. The movable contact members 3 and 4 are of the same shape and they are merely attached to the operation member 5 so that the rear surfaces thereof are opposed to each other. The operation member 5 to which the movable contacting members 3 and 4 are attached is snapped in the case members by the fastener portions 5c to complete the assembling of the switch. Therefore, the switch according to the present invention can be assembled with ease.

Moreover, the terminals 6 and 8 are integrally formed with the corresponding contacts 1h and 1g and housed within the case members 1 and 2, and the surfaces of the contacts and the bottom inner surfaces of the case members are in the same plane. Consequently, abrasion does not occur on the movable contacting members 3 and 4.

The inclined surfaces 1d on the projected peripheral portions 1a of the case member 1 can be utilized as stoppers for the lever portion 5a and thus, no additional means is needed for restricting the movement of the lever portion 5a. This allows the number of parts to be reduced and the operation to be simplified. Owing to a combination of a single operation member 5 to which movable contact members of the same shaped are attached, and a pair of complementary case members 1 and 2 in which contacts the terminals are provided, the present invention may provide a switch of an extremely small thickness.

The present invention is not, of course, limited to the above-described embodiment; it may be modified in various ways within the scope of the appended claims.

What is claimed is:

1. A switch comprising a first and second case member each including a recessed base portion having a central opening therethrough, said case members being joined together with the recesses of said base portions facing one another to form a central space;

each of said case members having a respective plurality of fixed contacts and a single common contact fixed within the recess of its base portion so as to lie around said opening therein, each of said contacts having a terminal portion extending outwardly from the respective case member;

an operation member having a disc member disposed rotatably within said space and a lever portion extending outwardly from said joined case members for rotating said disc portion about the axis of said openings;

fastener members extending axially outward from respective faces of said disc portion, said fastener members each having end portions adapted to extend through a respective opening of a case member to engage the outer surface thereof for holding said case members together; and a first and second contact member each secured to respective faces of said disc portion and slidable along the contacts within a recess of a respective base portion to enable selective switching between the contacts by actuation of said lever portion.

2. A switch according to claim 1, said contacts and their unitary terminal portions being integral with their respective case members.

3. A switch according to claim 1, a plurality of recessed portions corresponding in number to the number of fixed terminals being provided in the recess of each base portion said recessed portions providing detent operation of the respective contact member as it is moved thereover.

4. A switch according to claim 3, said recessed portions being formed in the respective common terminal.

5. A switch according to claim 1, the adjoining surfaces of said case members being provided with projections and recesses complementary to one another so as to be mutually interfitted.

6. A switch according to claim 1, each case member having a peripheral portion raising about the base portion thereof, said peripheral portions each having arcuate cutout portions which, when joined together, form a slot for receiving said lever portion.

7. A switch according to claim 6, the end portions of said cutout portions serving as stoppers for limiting the range of motion of said lever portion.

8. A switch according to claim 1, the outer surface of each case member engaged with an end portion of said fastener member being recessed inwardly of said outer wall whereby said end portions will not protrude from said outer wall.

9. A switch according to claim 1, each of said base portions having cylindrical supporting portions extending inwardly from the openings therein.

10. A switch according to claim 9, said first and second movable contact members each having a central hole fitting over said supporting portions.

11. A switch according to claim 1, each face of said disc portion being provided with respective projections on which said first and second contact members are fitted.

12. A switch according to claim 11, said operation member is unitarily formed from a synthetic resin.

13. A switch according to claim 11, said first and second contact members each having holes fitting over respective projections of said disc member.

* * * * *